US008814719B2

(12) United States Patent
Wall, Jr.

(10) Patent No.: US 8,814,719 B2
(45) Date of Patent: Aug. 26, 2014

(54) LIGHTWEIGHT GRIP FOR SPORTS EQUIPMENT

(75) Inventor: Broadus Perry Wall, Jr., Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 199 days.

(21) Appl. No.: 13/526,770

(22) Filed: Jun. 19, 2012

(65) Prior Publication Data

US 2013/0337933 A1 Dec. 19, 2013

(51) Int. Cl.
*A63B 53/14* (2006.01)

(52) U.S. Cl.
USPC ..... 473/300

(58) Field of Classification Search
CPC ..... A63B 53/14; A63B 53/145; A63B 53/16; A63B 59/0014; A63B 59/0025; A63B 59/0029; A63B 59/0033; A63B 59/0037
USPC ..... 473/300–303, 549–552, 568; D21/756; D8/DIG. 6, DIG. 7, DIG. 8; 74/551.9; 81/489–492; 16/DIG. 12, DIG. 18, 16/DIG. 19, DIG. 24, 421, 430; 280/821
See application file for complete search history.

(56) References Cited

U.S. PATENT DOCUMENTS 1,212,038 A * 1/1917 Flaxman ..... 473/44
2,226,468 A * 12/1940 Kimmich ..... 473/203
3,915,021 A * 10/1975 Schwartz et al. ..... 74/89.27
4,633,552 A * 1/1987 Eriksson ..... 407/29.15
RE34,767 E * 10/1994 Soong ..... 473/300
5,711,720 A * 1/1998 Janes et al. ..... 473/300
5,813,921 A * 9/1998 Huang ..... 473/300
5,845,364 A * 12/1998 Chen ..... 16/436
6,875,123 B2 * 4/2005 Wilson ..... 473/239
6,932,711 B2 * 8/2005 Benson ..... 473/239
6,988,958 B2 * 1/2006 Roelke ..... 473/295
7,931,544 B2 * 4/2011 Gill ..... 473/300
8,182,361 B2 * 5/2012 Gill ..... 473/299
8,296,907 B2 * 10/2012 Gill et al. ..... 16/421
8,371,956 B2 * 2/2013 Walls ..... 473/303
8,419,566 B2 * 4/2013 Gill ..... 473/299
2003/0083144 A1 * 5/2003 Shin ..... 473/296
2003/0084756 A1 * 5/2003 Schroder et al. ..... 81/20
2008/0113826 A1 * 5/2008 Lin ..... 473/302
2012/0258817 A1 * 10/2012 Beach et al. ..... 473/296

FOREIGN PATENT DOCUMENTS

GB 461562 * 2/1937

* cited by examiner

*Primary Examiner* — Stephen L. Blau
(74) *Attorney, Agent, or Firm* — Rebecca Hanovice; Michael A. Catania; Sonia Lari

(57) ABSTRACT

A lightweight grip assembly is disclosed herein. The lightweight grip assembly comprises a rigid support structure comprising a hollow portion and a grip portion comprising a substantially uniform thickness, wherein the grip portion is disposed on an external surface of the rigid support structure. The lightweight grip assembly may be used in connection with golf club shafts and heads having one or more adjustable features to increase the amount of overall discretionary weight available to a golfer.

11 Claims, 2 Drawing Sheets

LIGHTWEIGHT GRIP FOR SPORTS EQUIPMENT

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a lightweight grip assembly for use with sports equipment having shafts or handles, and particularly golf club shafts. More specifically, the present invention relates to a golf club grip assembly that can be used with adjustable golf clubs to free up additional mass for the adjustable features of the golf clubs.

2. Description of the Related Art

Customization of golf clubs to help golfers attain better shots has become a popular and more prevalent practice in recent years. Golf club manufacturers and designers have devised various features to allow club fitters and golf club players to adjust certain characteristics of their clubs. Such characteristics include loft, lie, face angle, center of gravity (CG) location, club length, and overall club weight. These adjustability features often add weight to the golf clubs with which they are provided, however, thus constraining the extent of adjustments available to golfers if they want their clubs to be compliant with USGA standards.

Golf club grips are typically formed from elastomeric materials such as rubber and plastic. When shaped into standard grip dimensions, these materials add a great deal of weight, typically from 40 to 60 grams, to the clubs with which they are used. This weight makes such grips undesirable for use with a club having adjustability features. There is therefore a need for lightweight grips that can be used with adjustable clubs to accommodate the weight of the adjustment features and to allow for a greater range of overall weight adjustability.

BRIEF SUMMARY OF THE INVENTION

One aspect of the present invention is a lightweight grip comprising a support structure comprising an exterior surface, an upper edge, a lower edge, and a hollow portion, and a grip portion comprising a substantially uniform thickness, wherein the support structure is composed of a rigid material, and wherein the grip portion is disposed on the exterior surface of the support structure. The thickness of the grip portion may be no less than 0.005 inch and no more than 0.250 inch, and more specifically no less than 0.010 inch and no more than 0.065 inch. The grip portion may have a weight of no less than 5 grams and no more than 30 grams, and be composed of an elastomeric material, such as rubber or plastic. The hollow portion of the support structure may increase in volume from the lower edge to the upper edge of the support structure. The support structure may further comprise a cylindrical interior surface, an upper opening, and a lower opening, and wherein the cylindrical interior surface is sized to encircle a shaft. The lightweight grip may further comprise a cap sized to close the upper opening of the support structure and engage with the shaft.

In some further embodiments, the lightweight grip may further comprise a shaft having a distal end and a proximal end, wherein the lightweight grip is affixed to an exterior surface of the distal end. The shaft may be an adjustable length shaft, and the shaft may further include a golf club head affixed to its proximal end. In some embodiments, the golf club head may comprise one or more adjustability features.

Another aspect of the present invention is a golf club comprising a shaft comprising a distal end and a proximal end, a golf club head affixed to the proximal end, and a lightweight grip assembly affixed to the distal end, the lightweight grip assembly comprising a support structure, a grip portion, and a cap, wherein the support structure comprises an exterior surface, an upper edge, a lower edge, a hollow portion, a cylindrical interior surface sized to encircle the shaft, and an upper opening, wherein the hollow portion increases in volume from the lower edge to the upper edge of the support structure, wherein the grip portion comprises a substantially uniform thickness of no less than 0.005 inch and no more than 0.250 inch, and wherein the cap is sized to close the upper opening of the support structure. In some embodiments, at least one of the shaft and the golf club head may comprise one or more adjustable features. The shaft may comprise a first engagement structure and wherein the cap may comprise a second engagement structure sized to removably engage with the first engagement structure.

Yet another aspect of the present invention is a golf club shaft comprising a distal end comprising a lightweight grip assembly, and at least one adjustable feature, wherein the lightweight grip assembly comprises a composite support structure and a rubber grip portion, wherein the grip portion comprises a substantially uniform thickness, and wherein the support structure comprises a hollow portion. In some embodiments, the golf club shaft may further comprise a cap removably engaged with the support structure and the distal end of the shaft. In some embodiments, the at least one adjustable feature may selected from the group consisting of shaft length and shaft weight. In other embodiments, the hollow portion may increase in volume from a lower edge to an upper edge of the support structure.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to a lightweight grip assembly 10 that can be used in connection with any type of sports equipment requiring a shaft or gripping handle, and more particularly with adjustable golf club shafts and/or golf club shafts affixed to adjustable golf club heads to accommodate the weight of adjustability features and removable or adjustable weights.

Figure 1:
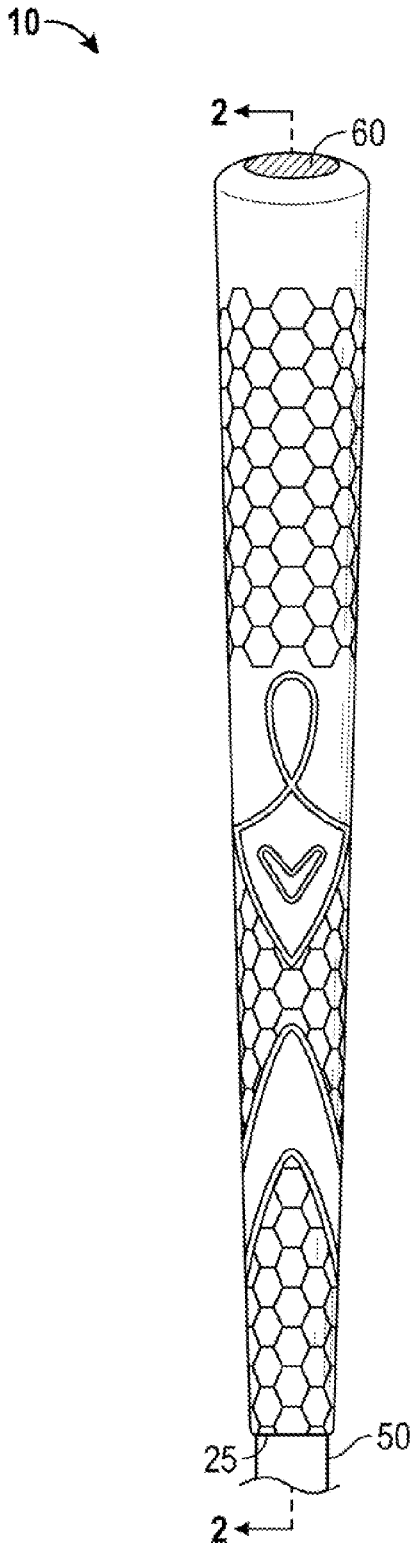
FIG. 1 is a side perspective view of a first embodiment of the lightweight grip assembly of the present invention.
Figure 2:
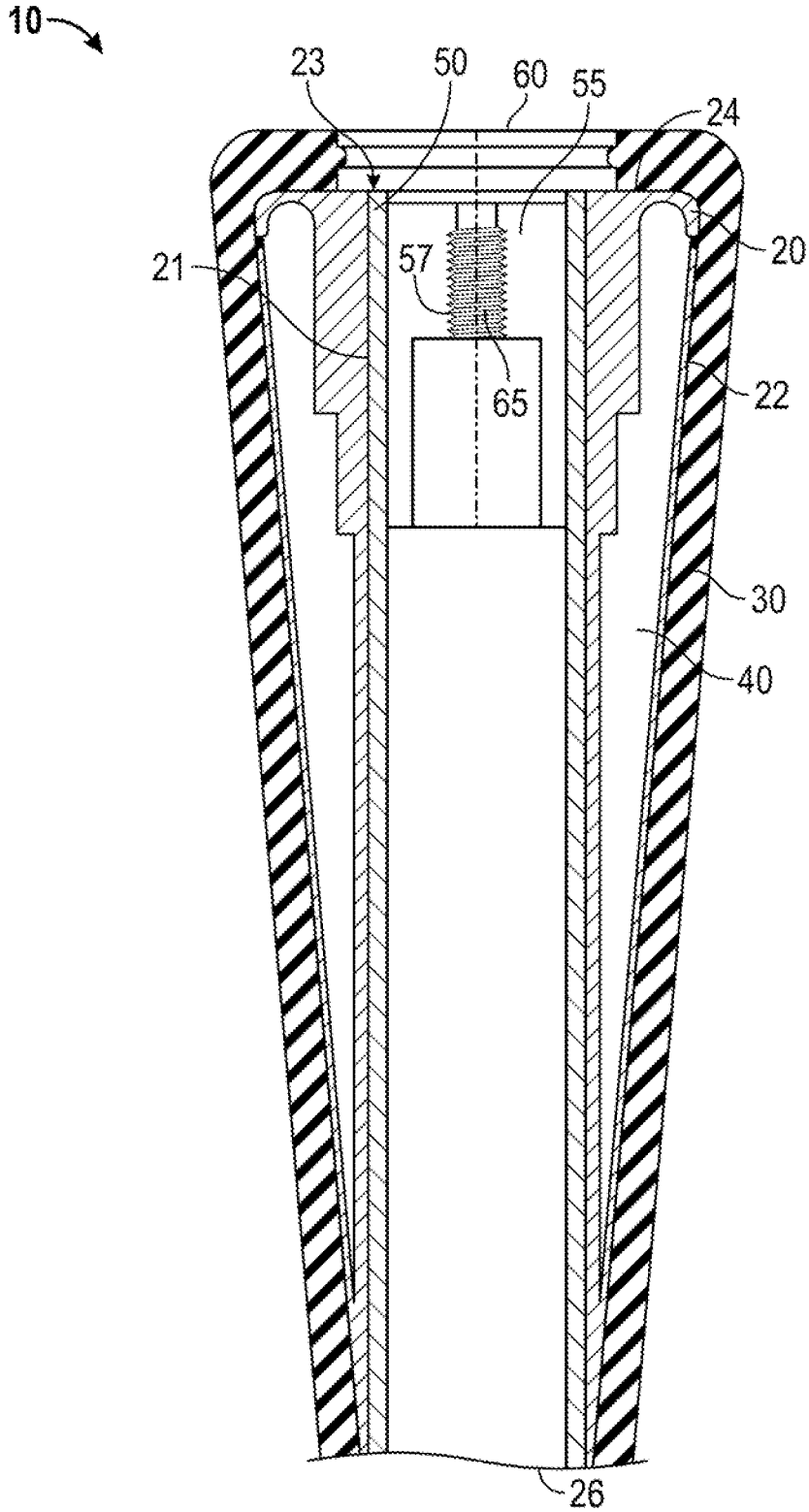
FIG. 2 is a cross-sectional view of the embodiment shown in FIG. 1 along lines 2-2.

FIGS. 1-2 show a preferred embodiment of the present invention. In this embodiment, the grip assembly 10 comprises a rigid support structure 20 having a cylindrical interior surface 21 sized to receive a shaft 50, a conical external surface 22, an upper opening 23, an upper edge 24, a lower opening 25, and a lower edge 26. The support structure 20 also comprises a hollow portion 40 extending between the upper and lower edges 24, 26 of the support structure 20.

The hollow portion 40 preferably increases in volume as it extends from the lower edge 26 to the upper edge 24 of the support structure 20, giving the support structure 20 a gently tapering, conical overall shape. The hollow portion 40 also removes a significant amount of weight from the overall construction of the lightweight grip assembly 10. The support structure 20 may be composed of any rigid, lightweight material, including titanium, graphite or carbon composite, plastic, magnesium, aluminum, steel, or alloys of such materials, such as stainless steel 17-7 or titanium 6-4. In the preferred embodiment, the support structure 20 is composed of a composite material.

The lightweight grip assembly 10 of the present invention also includes a grip portion 30, which is disposed on the external surface 22 of the support structure 20. The grip portion 30 may be adhered to the external surface 22 with an adhesive or mechanical device, or it may be affixed by wrapping the grip portion 30 tightly around the support structure 20. Though the grip portion 30 may be composed of any type of material, it is preferably composed of a soft, elastomeric material such as rubber or plastic. The grip portion 30 preferably has a consistent thickness of 0.005-0.250 inch, more preferably of 0.010-0.065 inch, and preferably has an overall weight of 2 to 40 grams, and more preferably of 5 to 20 grams.

As shown in FIG. 2, once the lightweight grip assembly 10 of the present invention is disposed over a shaft 50, the upper opening 23 of the support structure 20, which is ringed by the grip portion 30, preferably is closed with a cap 60. The cap 60, which may be composed of any type of lightweight material, but preferably is composed of a plastic material, plugs the upper opening 23 of the support structure 20, abuts the grip portion 30, and engages with an internal surface or structure 55 within the shaft 50, thus removably fixing the lightweight grip assembly 10 to the shaft 50. In the preferred embodiment, the cap comprises a threaded extension 65 that removably engages with mating threads 57 in the internal shaft structure 55.

The present invention is particularly useful when attached to golf clubs designed for golfers who require lighter overall club weights, such as women and senior golfers, to further reduce the overall weight of their golf clubs. The present invention can also be used with adjustable shafts, including those disclosed in U.S. patent application Ser. Nos. 13/323,539, 13/286,791, 13/100,140, 13/038,254, 13/008,806, and 13/009,710, the disclosure of each of which is hereby incorporated by reference in its entirety herein.

The pieces of the lightweight grip assembly 10 of the present invention may be composed of one or more of any number of materials, including metals, plastics, rubbers, urethanes, and composites, and may have any number of dimensions so long as they achieve the functions described herein. The pieces of the lightweight grip assembly 10 disclosed herein may also be bonded together with an adhesive to prevent unwanted separation and ensure adequate strength during club use. The lightweight grip assembly 10 disclosed herein may be used with any type of golf club head, including irons, woods, and putters.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A lightweight grip comprising:

a support structure comprising a conical exterior surface, an upper edge, a lower edge, a cylindrical interior surface, an upper opening, a lower opening, and an uninterrupted, conical hollow portion between the exterior surface and the interior surface; and a grip portion comprising a substantially uniform thickness, wherein the support structure is composed of a rigid material, wherein the hollow portion gradually increases in volume from the lower edge to the upper edge of the support structure, wherein the cylindrical interior surface is sized to encircle a shaft, and wherein the grip portion is disposed on the exterior surface of the support structure.

2. The lightweight grip of claim 1, wherein the thickness of the grip portion is no less than 0.005 inch and no more than 0.250 inch.

3. The lightweight grip of claim 2, wherein the thickness of the grip portion is no less than 0.010 inch and no more than 0.065 inch.

4. The lightweight grip of claim 1, wherein the grip portion has a weight of no less than 5 grams and no more than 30 grams.

5. The lightweight grip of claim 1, wherein the grip portion is composed of an elastomeric material.

6. The lightweight grip of claim 1, wherein the grip portion is composed of a material selected from the group consisting of rubber and plastic.

7. The lightweight grip of claim 1, further comprising a cap sized to close the upper opening of the support structure and engage with the shaft.

8. The lightweight grip of claim 1, further comprising a shaft having a distal end and a proximal end, wherein the lightweight grip is affixed to an exterior surface of the distal end.

9. The lightweight grip of claim 8, wherein the shaft is an adjustable length shaft.

10. The lightweight grip of claim 8, further comprising a golf club head affixed to the proximal end.

11. The lightweight grip of claim 10, wherein the golf club head comprises one or more adjustability features.

* * * * *